US005370145A

United States Patent [19]

Wu

[11] Patent Number: 5,370,145

[45] Date of Patent: Dec. 6, 1994

[54] EASY SHIELD

[76] Inventor: Wen-Yu Wu, 28925 Pinecastle Dr., Rancho Palos Verdes, Calif. 90274

[21] Appl. No.: 966,444

[22] Filed: Oct. 26, 1992

[51] Int. Cl.[5] ..... E04H 15/40

[52] U.S. Cl. ..... 135/127; 135/905; 135/128

[58] Field of Search ..... 135/102, 104, 905, 106, 135/109, 119

[56] References Cited

U.S. PATENT DOCUMENTS

| | | | |
|---|---|---|---|
| 3,990,463 | 11/1976 | Norman | 135/104 |
| 4,520,835 | 4/1985 | Moeller | 135/104 X |
| 4,745,936 | 5/1988 | Scherer | 135/104 |
| 4,766,918 | 8/1988 | Odekirk | 135/102 X |
| 5,067,505 | 11/1991 | Cantwell et al. | 135/104 |
| 5,080,119 | 1/1992 | Scherer | 135/104 |
| 5,088,740 | 2/1992 | Peterson | 135/104 X |
| 5,159,948 | 11/1992 | Moreau et al. | 135/104 |
| 5,163,461 | 11/1992 | Ivanovich et al. | 135/104 |

*Primary Examiner*—Carl D. Friedman
*Assistant Examiner*—Lan C. Mai

[57] ABSTRACT

A collapsible shield including flat spring frame and flexible sheet material. The frame substantially supporting the sheet material to form a shield. During the folding process for storage, the frames can be formed to a loop configuration by bending and having the ends of each frame held together by any suitable means such as coupling, retaining clip. The loop frames are collapsed by twisting and folding to form a plurality of concentric loop rings and layers of fabric to substantially reduce the size of the shield.

1 Claim, 2 Drawing Sheets

EASY SHIELD

A self-erecting structure having two or more flexible coilable resilient material forming frame members which are affixed to a flexible sheet like material, or fabric.

The structure will typically be, but not limited, in the form of a tent and will be so referred to hereinafter.

The frame, as described above, is held in the desired in-use configuration by securement at least a plurality of points between the fabric and frame.

By joining together the two ends of each frame member by suitable means such as in the Detailed Description and forming a flexible loop. The loop members are collapsed by twisting and folding to form a plurality of concentric loop rings and layers of fabric to substantially reduce the size for storage.

DETAILED DESCRIPTION

Figure 1:
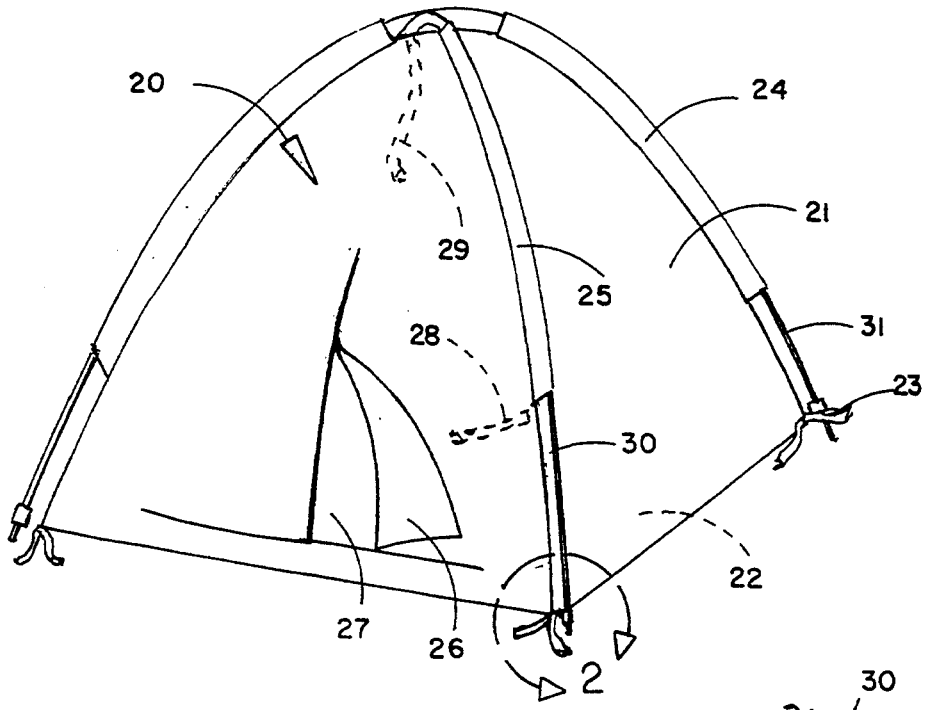
FIG. 1 is an isometric view of a sample tent structure.
Figure 2:
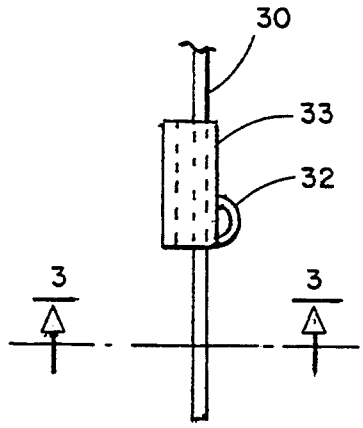
FIG. 2 is the detail view of one end of the frame member taken from FIG. 1.

FIG. 1 shows a dome-style tent 20 which comprises two frames 30 and 31, side panel 21 on the frames formed into an enclosure having a floor panel 22, any fabric-like sheet material can be used for the panels. The frame members 30 and 31 extend through sleeve 24 and 25, respectively, of the side panel 21 to support and tension the panels. Tie member 23 are provided at the lower corners of the tent. To provide acess to the interior of the tent 20, the material of one of the side panel 21 is cut to form a door 26 which can be opened to provide a opening 27. Elastic strings 28 and 29 are located in the tent 20. String 29 stitched to the tent at the apex of the tent. String 28 is stitched to the floor panel 22, directly opposided string 29. Usage will hereinafter be described.

The material of frame 30 and 31 is flat spring which is relatively strong and yet is flexible to a sufficient degree to allow it to be coiled. A coupling 33 is welded to each ends of the frame or by and other means, such as rivet, fastener. Each coupling 33 has a eyelet 32 thereof to allow the tie member 23 to be tied to the frame at each corner to a downwardly and outwardly directed pull on the side panels 21.

Figure 4:
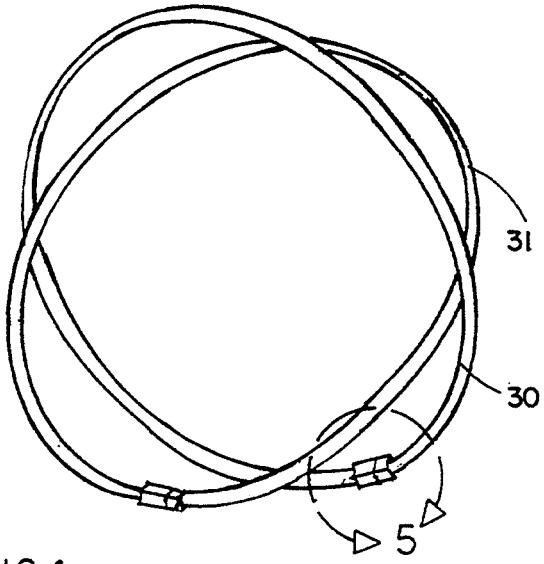
FIG. 4 is the view of the frame members as the two ends of each frame joined together.
Figure 3:
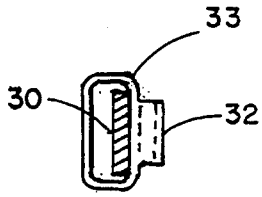
FIG. 3 is the section view taken along line 3—3 of FIG. 2.
Figure 5:
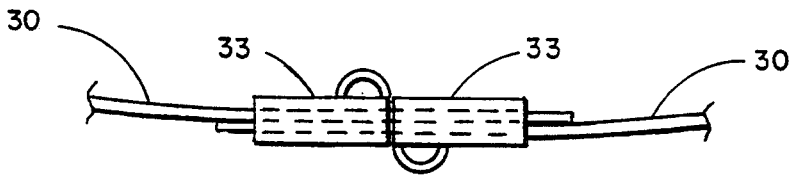
FIG. 5 is the detail view of the joined ends of frame taken from FIG. 4.
Figure 6:
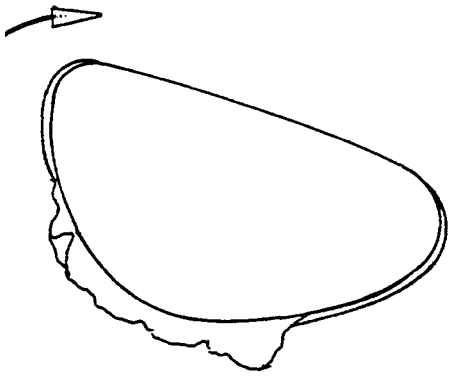
FIGS. 6~10 illustrate the manipulation of the frame member to collaspe the tent.
Figure 7:
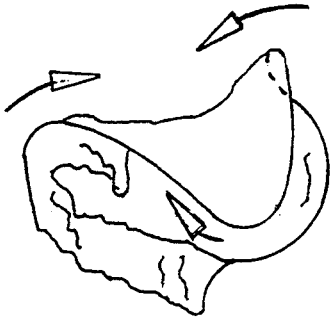
Figure 8:
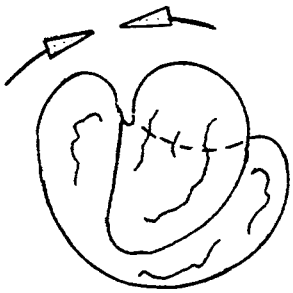
Figure 9:
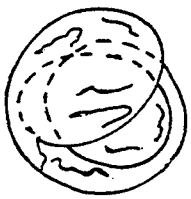
Figure 10:
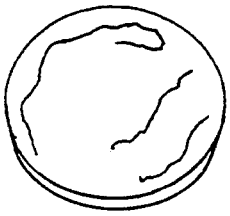

The first step for folding up the tent for storage consists of tieing the elastic strings 28 and 29 together so that the floor panel 22 are pulled toward the apex of the tent and stuffed between the side panels 21. Then both ends of frame 30 are joined together by any suitable means such as coupling 33 (shown on FIG. 5) and the frame 30 is formed to a loop configuration. Frame 31 is formed to another loop by the same means FIG. 4 shows the two loop frames, panels are omitted for clarity. Next, an upwardly directed portion of the frame loops are pulled toward and held generally adjacent the opposite side of the loops as shown by the arrow in FIG. 6. Following this, the other sides of the loop are pushed together as shown by the opposing arrows on FIG. 7 causing the near upper portion to tuck inside the remainder of the structure as indicated by the third arrow in FIG. 7. The process continues as shown in FIG. 8, by pushing one of the frame portions being manipulated inside the other. This continues the automatic tucking of the near portion and the collapse completes essentially by itself through the position shown in FIG. 9 and to the fully collapsed condition shown in FIG. 10. Erecting the tent from its storage configuration requires simply the reversal of the above steps.

I claim:

1. A method of collapsing a shield of the type comprising a fabric cover supported by a frame having at least two flexible coilable flat spring poles; said fabric cover including a plurality of side panels, a floor panel and a plurality of corners, first and second criss-crossing sleeves for receiving said poles, each sleeve defining a passage having at least one open end for continuous insertion of a pole into the respective sleeve; each of said poles having opposed ends positioned at said corners; said method of collapsing comprising the following steps:

joining opposed ends of each pole together by a coupling means to form a closed-loop configuration, folding the loops and the fabric cover on top of each other, collapsing said loops by twisting, folding to form a compact bundle of a plurality of loop rings and layers of fabric.

* * * * *